US006614186B2

(12) United States Patent
Mehr et al.

(10) Patent No.: US 6,614,186 B2
(45) Date of Patent: Sep. 2, 2003

(54) SHORT-ARC LAMP

(75) Inventors: Thomas Mehr, Dollenstein (DE); Dietmar Ehrlichmann, Berlin (DE); Gerhard Loeffler, Eichstaett (DE)

(73) Assignee: Patent-Treuhand-Gesellschaft für Glühlampen mbH, Munich (DE)

( * ) Notice: Subject to any disclaimer, the term of this patent is extended or adjusted under 35 U.S.C. 154(b) by 41 days.

(21) Appl. No.: 09/821,488

(22) Filed: Mar. 29, 2001

(65) Prior Publication Data

US 2001/0035719 A1 Nov. 1, 2001

(30) Foreign Application Priority Data

Mar. 30, 2000 (DE) ..... 200 05 764 U

(51) Int. Cl.[7] ..... H01J 17/04; H01J 61/04; H01J 17/20

(52) U.S. Cl. ..... 313/631; 313/574; 313/632; 313/634

(58) Field of Search ..... 313/631, 632, 313/634, 620, 621, 491, 574

(56) References Cited

U.S. PATENT DOCUMENTS 3,248,591 A * 4/1966 Arndt ..... 313/40
3,474,278 A 10/1969 Thouret et al.
3,706,000 A * 12/1972 Retzer et al. ..... 313/570
3,876,905 A * 4/1975 Lutz et al. ..... 315/157
5,712,530 A 1/1998 Inoue et al.
5,818,169 A 10/1998 Morimoto et al.
5,874,805 A * 2/1999 Kavanagh ..... 313/631
6,211,615 B1 * 4/2001 Altmann et al. ..... 313/631

FOREIGN PATENT DOCUMENTS

DE 976223 6/1963
DE 19749908 5/1999
GB 2107921 A * 5/1983 ..... H01J/61/073

OTHER PUBLICATIONS

Web Page: http://www.asltg.com/XenonArc3.htm.*
Web Page: http://www.pupman.com/listarchives/1998/April/msg00283.html.*
Web Site: www.Sylvania.com for product catalog.*

* cited by examiner

*Primary Examiner*—Nimeshkumar D. Patel
*Assistant Examiner*—Anthony Perry
(74) *Attorney, Agent, or Firm*—Frishauf, Holtz, Goodman & Chick, P.C.

(57) ABSTRACT

A short-arc lamp (1) with a discharge vessel (2) which contains an anode (3) and cathode (4) which are opposite one another. The filling medium contains inert gases and/or metal vapors, and the anode comprises a body having a front section (11), a substantially cylindrical body (12) and a rear face (13). Provided in the region of the front half of the cylindrical body is a projection (20) whose radial length (X) projects at least 0.5 mm beyond the cylindrical body (12).

11 Claims, 4 Drawing Sheets

SHORT-ARC LAMP

FIELD OF THE INVENTION

The invention involves short-arc lamps and, in particular, xenon short-arc lamps of high power. Moreover, the invention can also be applied to other short-arc lamps such as mercury short-arc lamps and to DC lamps whose anode has a large diameter. A preferred application is in discharge lamps for still image applications (for example large image slide projection) and digital projection techniques, where the arc movement is more strongly perceived, since there is no movement of the film.

BACKGROUND OF THE INVENTION

The problem of arc instability has previously been regarded essentially only as an electrode phenomenon. Efforts made to date have attempted only to find an electrode shape which is suitable for the discharge and is as favorable as possible in terms of flow (U.S. Pat. No. 5,818,169). However, no account has been taken of the turbulent reverse flow in lamp bulbs. Thus, turbulent disturbances of the discharge arc by the gas flowing in reverse cannot be avoided.

The following measures have so far been applied to minimize arc instability:

1. Reduction of the filling pressure in simultaneous conjunction with increasing the arc spacing, in order to obtain the same lamp voltage with the same current. However, for photo-optical applications it is important to have an arc spacing which is as small as possible in order to simulate a light source which is as punctiform as possible.
2. Reduction of the current, since the instances of gas turbulence also become smaller with a smaller current. However, it is disadvantageous in this case that the radiant flux is also reduced thereby.
3. Operation of the lamp in a vertical burning position with the anode on top. However, this considerably limits the field of application.

All these measures combat the consequences of the turbulence rather than preventing them from occurring.

SUMMARY OF THE INVENTION

It is an object of the present invention to provide a short-arc lamp which is distinguished by very low arc instability.

This and other objects are attained in accordance with one aspect of the present invention directed to a short-arc lamp with a discharge vessel which, in addition to a filling medium, contains an anode and a cathode which are opposite one another. The filling medium contains inert gases and/or metal vapors. At least the anode comprises a substantially cylindrical body with two end faces. Provided in the region of the front half of the cylindrical body is a projection whose radial length projects at least 0.5 mm beyond the cylindrical body.

DETAILED DESCRIPTION OF THE DRAWINGS

Figure 1:
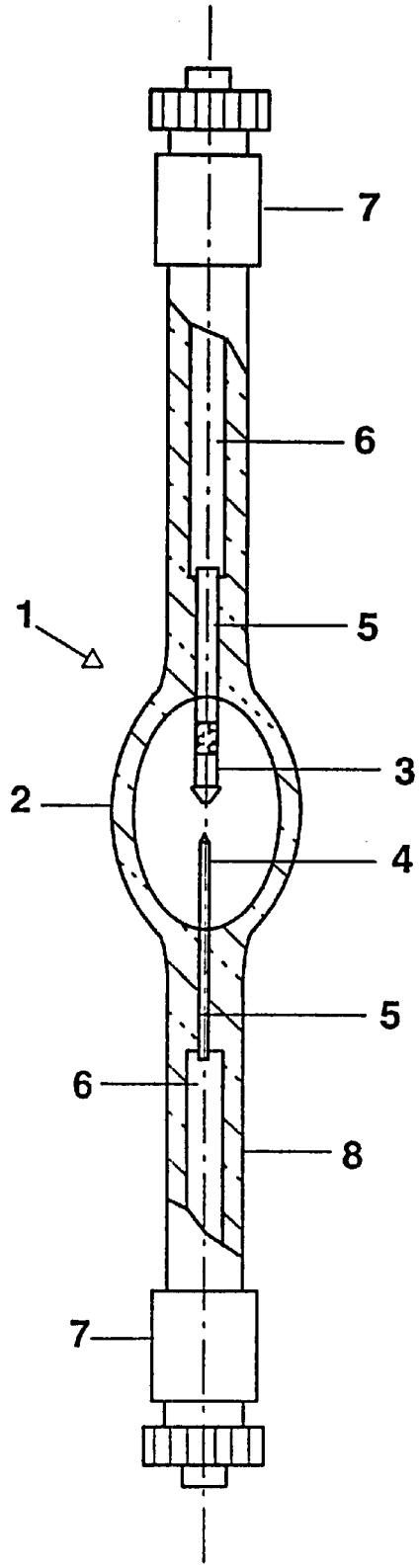
FIG. 1 shows a discharge lamp in section.

The present invention is particularly suitable for xenon short-arc lamps, such as those having a high cold filling pressure greater than 5 bars. It is not only vertical burning positions, but also horizontal ones and ones with any desired inclination, which it makes possible. It is particularly suitable to apply it to the form of the anode in DC lamps, but the principle can also be applied, however, to the cathode given high wattages. The ideal arc burns stably without any movement. However, in reality the arc is influenced by the movements of the filling gas. Two forces essentially occur in this case, namely:

1. the natural convection presses the arc upward, and
2. the specific current density distribution in the arc and the self-magnetic field thereof give rise in DC lamps to a strong acceleration of the plasma in the direction of the anode. The axial gas flow thereby produced hits the anode front side and is deflected over the lateral surface of the anode. For this reason, at least the outer region of the front side of the anode should be conically formed.

The dominant force for accelerating the gas is the electromagnetic force in the arc. Both laminar and turbulent flow can occur when the anode is flowed around. Downstream of the anode, the flowing filling medium (filling gas, such as xenon, krypton or argon; or vapor, such as mercury or another metal) strikes the end of the bulb and reverses its direction of movement. This reverse flow takes place along the bulb wall and is steered in the direction of the cathode again by the curvature of the bulb. Thus, a permanent flow of the filling medium prevails in the bulb, the flow being directed near the lamp axis in the direction of the anode, and near the bulb wall in the direction of the cathode. Superimposed on this flow is the convection which, in the case of a horizontal burning position or slight inclination, deflects the gas perpendicular thereto.

The arc instability is influenced in the following two ways by these gas flows:

1. the instances of turbulence in the filling medium interact with the arc plasma and lead to unstable burning behavior, and
2. the light emitted by the arc must penetrate the gas volume before it leaves the bulb through the wall. Owing to the high gas density and the instances of turbulence in the gas, the refractive index in the gas volume is subjected to strong fluctuations. This can give rise to substantial deviations in the emitted light.

The invention minimizes the negative influences of the flow of the filling medium (in particular xenon and/or mercury) on the arc, the result being to improve the arc instability of the lamp.

The effects described are increasingly disturbing for:

1. relatively large arc spacings (>2 mm, typically 3 to 10 mm);
2. high filling pressures (>5 bars cold filling pressure of an inert gas, or >15 bars operating pressure of the filling medium); and
3. high current (>50 A).

The following important influencing variables have emerged from experiments. The measures aim at exposing the arc and the emitted light inside a bulb to instances of gas turbulence which are as slight as possible. In addition to the suitable position of the arc in the bulb, the energy of the gas flow is an important variable. The influence on the arc also increases with increasing kinetic energy of the gas flow.

The invention employs a shaping of the anode (but also of the cathode in the case of high-power lamps) in order to reduce the kinetic energy of the filling medium.

If the anode diameter is reduced downstream of the front arc attachment surface, there is a projection (protrusion) which causes eddying of the filling at this point. The flow loses energy substantially in this eddy. In the rear region of the anode lateral surface, the filling medium flows off in laminar fashion and with low kinetic energy. The arc instability remains slight over the entire lifetime of the lamp.

In detail, the anode is designed such that a cylindrically formed body with two end faces is seated on a shaft. It has on the discharge side a front face which is frequently constructed as a front section which tapers to a tip or a plateau. The end face (rear face) averted from the discharge is mostly flat. The cylindrical body has a projection or protrusion on its front half. The cross section of the cylindrical body can be a circle, but also an ellipse or the like.

The anode advantageously has a conically tapering or curved (for example hemispherically shaped) front section with or without a plateau at its tip, the projection advantageously being constructed directly at the interface between the cylindrical body and the front section. However, the projection can also be constructed somewhat further downstream in the front half of the cylindrical body. A projection with a length of 0.5 mm on the lateral surface is already sufficient to generate the eddy, while smaller projections are of too little effect. A practical upper limit is provided, finally, by the amount of material required for the production of the anode. Consequently, the projection should not exceed a length of 5 mm, since the material must be removed (for example by turning). An alternative is a multipartite anode, the projection belonging to a first part, which faces a discharge, and the region of the remaining cylindrical body forming a second part.

Typical diameters of the anode in the rear half of the cylindrical body are in a range of approximately 10 to 30 mm. The diameter of the cylindrical body downstream of the projection can be constant or vary slightly (in particular, taper conically).

The projection advantageously has two edges which run rectilinearly or in a curved fashion. An advantage is an acute angle (<60°, in particular <45°) between the two edges, which reliably generates the energy consuming eddy. The radial length of the projection can then be particularly small. The projection can be designed for example in the shape of a V or saw-tooth fashion, or else in a rounded fashion.

The following further features are taken into account in particularly optimized embodiments.

The position of the arc in the bulb is optimum when the front face of the anode (or the anode plateau) is situated approximately in the middle of the bulb (at most ±5 mm deviation in the axial direction). The further the anode plateau is displaced in the axial direction beyond the center line of the bulb, the more the arc comes under the influence of strongly turbulent regions and different refractive indices. Depending on the power of the lamp, a maximum deviation within 3% of the total axial length of the discharge volume is recommended.

If the anode diameter is selected to be large in relation to the current, it is possible for there to form already in the conical region of the anode an additional eddy in which the flow loses energy substantially. If the diameter D is specified in mm and the current I in amperes, the ratio of $0.1<D/I<0.3$ (in particular $0.25>D/I>0.15$) proves to be advantageous for the purpose of generating this additional eddy.

Shown schematically in FIG. 1 is a DC-operated xenon short-arc lamp 1 with a power of 3000 W, which is used as a projection light source. The barrel-shaped discharge vessel 2 made from quartz glass is filled with xenon (cold filling pressure 11 bars, corresponding to an operating pressure of 40 to 50 bars). An anode 3 and a cathode 4 are arranged in the discharge vessel at a spacing of approximately 4 mm relative to one another axially. Each electrode 3, 4 has a shaft 5. The electricity supply is provided via molybdenum foils 6 which are guided outward via pins to metallic shell caps 7. The molybdenum foils 6 are sealed in a vacuum-tight fashion into the two ends 8 of the discharge vessel. Instead of a seal, it is also possible to use another technique such as a bar seal or cup seal.

Figure 2:
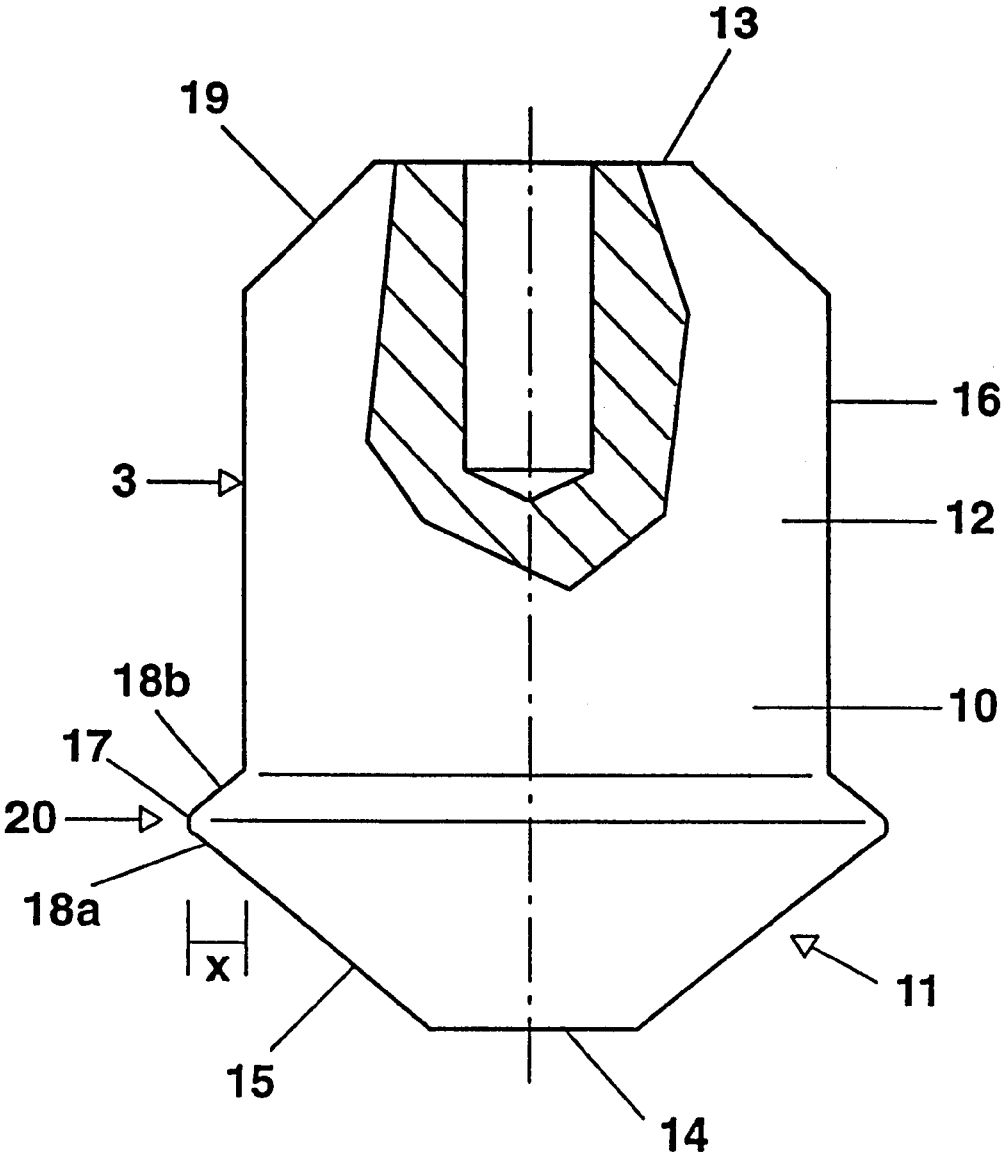
FIG. 2 shows an enlarged view of the anode of the discharge lamp depicted in FIG. 1.

The anode 3 is a solid cylindrical block made from tungsten. A first exemplary embodiment is shown in detail in FIG. 2. The anode has a head 10 with a front section 11, a body 12 and a rear face 13. The front section 11 has a central attachment surface 14 for the arc and an outer region 15 which runs conically outwards up to the outer wall 16 of the cylindrical body 12. The cylindrical body 12 has a diameter of 21 mm. Extending at the connecting region between the front section and cylindrical body is a circumferential projection 20 which is fashioned in the shape of a V in cross section and whose radial length x is approximately 0.5 mm, such that the maximum diameter of the anode is 22 mm overall. The projection 20 has two edges 18*a*, 18*b*, which meet at a sharp edge 17 and forms an acute angle of approximately 60°.

The length of the anode head 10 is 28 mm overall. The rear surface 13 is likewise connected with a slight bevel 19 to the cylindrical body 12.

Specified in the following table for this type and an entirely similarly fashioned type of higher power (4000 W) is the nominal current I and the outside diameter D of the cylindrical body of the anode, as well as the ratio D/I.

| Type of lamp | D/I | Nominal Current I | Anode diameter D |
|---|---|---|---|
| 3000 W | 0.20 | 110 A | 22 mm |
| 4000 W | 0.19 | 130 A | 25 mm |

When this ratio D/I is between 0.1 and 0.3, in particular between 0.15 and 0.25, an additional eddy forms in the region of the conical outer region 15 of the front section 11. The energy consumption is then particularly efficient.

Figure 3A:
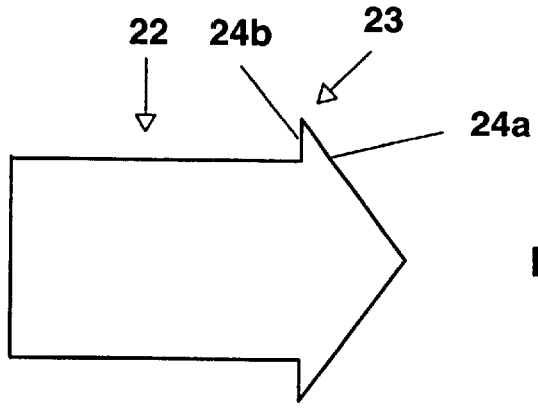
FIGS. 3*a* to 3*b* show further exemplary embodiments of anodes.
Figure 3B:
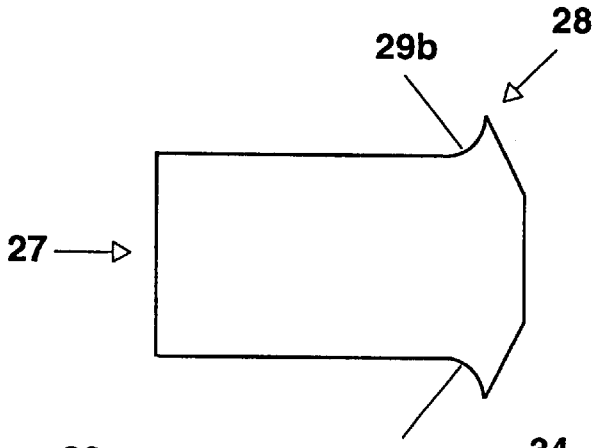
Figure 3C:
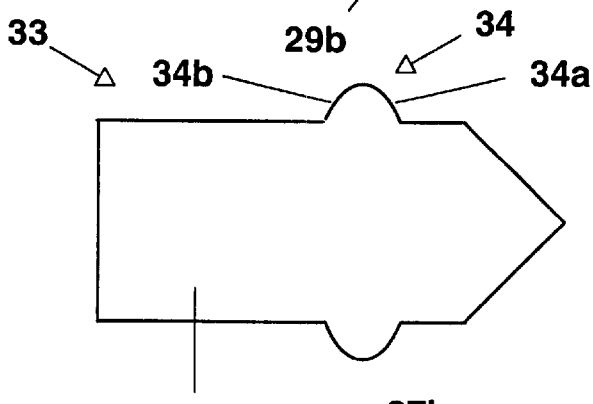
Figure 3D:
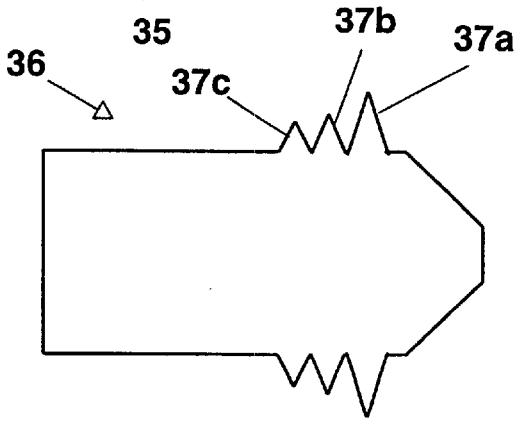

FIG. 3*a* to 3*d* show further suitable forms of the projections. Specifically, FIG. 3*a* shows a saw-tooth form of the projection 23 with a conical first edge 24*a* and a second edge 24*b*, which is at right angles to the axis of the anode 22. FIG. 3*b* shows an anode 27 having a form of the projection 28 with a curved second edge 29*b*. FIG. 3*c* shows a form of the anode 33 in the case of which the rounded projection 34 (half a dome) is seated relatively far behind on the cylindrical body 35 (at approximately 30% of its length), and FIG. 3*d* shows a form of the anode 36 with a plurality of V-shaped projections 37*a*, 37*b*, 37*c*, whose size decreases from the front to the rear.

Figure 4B:
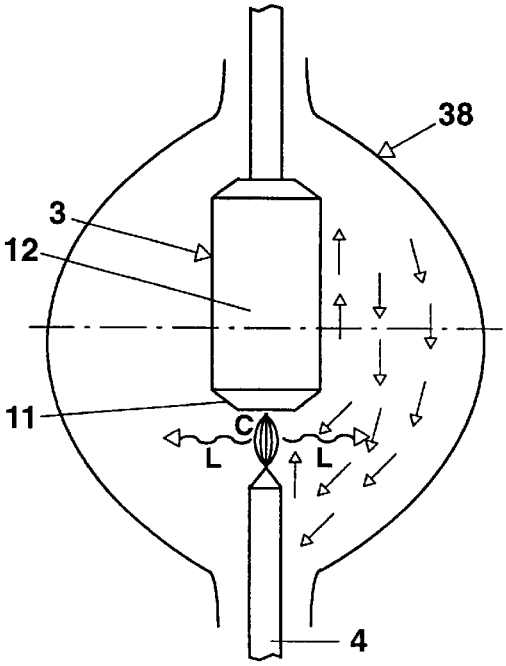
FIG. 4*a* shows an illustration of the flow relationships in a discharge lamp in accordance with the invention by way of comparison with a prior art lamp shown in FIG. 4*b*.
Figure 4A:
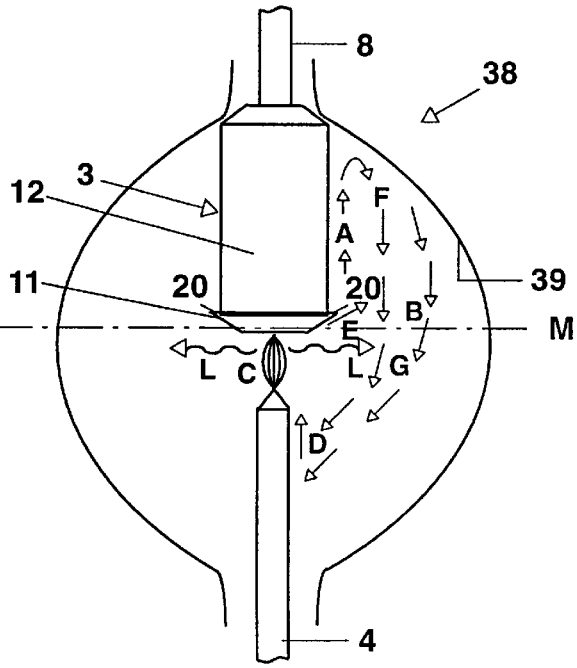

FIG. 4*a* shows a diagram of the flow relationships in a short-arc lamp with an elliptical discharge vessel 38. It is clearly to be seen that the flow (E) of the filling medium strikes the front section 11 of the anode and is guided from there via the projection 20 to the cylindrical body 12 of the anode (A). The flow is, therefore, directed away from the arc (C), which extends between the electrodes, to the end 8 of the bulb, and has only a narrow width, since the flow velocity is very high. The flow (A) can pass the cylindrical body in a laminar fashion, in particular. The flow (F) is deflected at the bulb end 8 and fans out, and the filling medium flows back over a wide area (B) on the curved bulb wall 39.

By virtue of the fact that the front section 11 of the anode is seated approximately in the middle (M) of the discharge vessel 38, the filling medium is directed (G) towards the shaft of the cathode because of the curvature of the bulb wall, but without disturbing the region of the arc (C). The light (L) of the arc is emitted outward without being disturbed. The filling medium flows along (D) at the shaft 5 of the cathode 4 toward the region of the arc.

By contrast therewith, a prior art configuration as shown in FIG. 4*b*, of which the front section 11 of the anode is arranged outside the middle (M) of the discharge vessel 38, has the effect that the filling medium also flows onto the axis in the region of the arc (C). The velocity component of the flow perpendicular to the lamp axis causes the arc to move aside (instances of interfering turbulence) and raises the density of the gas. Both effects impair the stability of the arc.

In order to further decrease the arc instability, it has proved to be favorable to use other measures whose basic use in lamp construction is certainly known, but which have not so far been used for this purpose, in order to extract kinetic energy from the gas flowing around, like the bores, known per se, in the anode lateral surface (DE-T 976 223 and U.S. Pat. No. 3,474,278) or grooves or depressions in the anode lateral surface (DE-A 197 49 908) or filaments on the shaft of the anode (U.S. Pat. No. 5,712,530).

We claim:

1. A short-arc lamp (1) with a discharge vessel (2) comprising a filling medium, an anode (3) and cathode (4) which are opposite one another, the filling medium containing inert gases and/or metal vapors, at least the anode (3) comprising a substantially cylindrical generated body (12) with two end faces (11, 13), the cylindrical body including a front half and a back half wherein a projection (20) is provided in the region of the front half of the generated body (12) whose radial length (x) projects at least 0.5 mm beyond a maximum diameter at the back half of the generated body (12).

2. The short-arc lamp as claimed in claim 1, wherein the projection (20) has a radial length of at most 5 mm.

3. The short-arc lamp as claimed in claim 1, wherein the projection (23; 37) has two edges (24*a*, 24*b*) which form an acute angle.

4. The short-arc lamp as claimed in claim 1, wherein the projection is fashioned with at least one curved edge (29*b*; 34*a*, 34*b*).

5. The short-arc lamp as claimed in claim 1, wherein a plurality of projections (37) are arranged in series with, in particular, their radial lengths decreasing.

6. The short-arc lamp as claimed in claim 1, wherein the end face on the discharge side is constructed as a tapering front section (11).

7. The short-arc lamp as claimed in claim 1, wherein the electrode spacing is at least 2 mm.

8. The short-arc lamp as claimed in claim 1, wherein the operating filling pressure is at least 15 bars.

9. The short-arc lamp as claimed in claim 1, wherein the current of the lamp is at least 50 A.

10. The short-arc lamp as claimed in claim 9, wherein a ratio D/I of $0.1<D/I<0.3$ is observed when the diameter D of the anode is specified in mm, and the current of the lamp I is specified in amperes.

11. The short-arc lamp as claimed in claim 1, wherein the end face (11) of the anode on the discharge side is arranged approximately in the middle of the bulb.

* * * * *